US008308203B1

(12) United States Patent
Spletzer et al.

(10) Patent No.: US 8,308,203 B1
(45) Date of Patent: Nov. 13, 2012

(54) ROTARY MECHANICAL LATCH

(75) Inventors: Barry L. Spletzer, Albuquerque, NM (US); Michael A. Martinez, Albuquerque, NM (US); Lisa C. Marron, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 541 days.

(21) Appl. No.: 12/496,413

(22) Filed: Jul. 1, 2009

Related U.S. Application Data

(60) Provisional application No. 61/139,044, filed on Dec. 19, 2008.

(51) Int. Cl.

| | |
|---|---|
| ***E05C 5/02*** | (2006.01) |
| ***E05C 5/00*** | (2006.01) |
| ***E05C 1/12*** | (2006.01) |
| ***E05C 1/06*** | (2006.01) |

(52) U.S. Cl. ..... 292/4; 292/57; 292/111; 292/172; 292/144

(58) Field of Classification Search ..... 292/4, 57, 292/111, 112, 172, 142, 144, 280, 216, 197, 292/199, 201, 202
See application file for complete search history.

(56) References Cited

U.S. PATENT DOCUMENTS

| | | | | |
|---|---|---|---|---|
| 4,321,867 | A | 3/1982 | Soderberg et al. | |
| 4,766,747 | A * | 8/1988 | Ernest | 70/264 |
| 4,948,183 | A * | 8/1990 | Yamada | 292/199 |
| 4,968,074 | A * | 11/1990 | Yamagishi et al. | 292/201 |
| 5,584,515 | A * | 12/1996 | Silye | 292/201 |
| 5,707,090 | A * | 1/1998 | Sedley | 292/172 |
| 5,918,917 | A * | 7/1999 | Elton et al. | 292/201 |
| 6,056,334 | A * | 5/2000 | Petzold et al. | 292/216 |
| 6,349,983 | B1 * | 2/2002 | Dupont et al. | 292/201 |
| 6,499,776 | B2 * | 12/2002 | Takamura | 292/201 |
| 6,511,106 | B2 * | 1/2003 | Perkins et al. | 292/216 |
| 6,557,910 | B2 * | 5/2003 | Amano | 292/201 |
| 6,997,488 | B2 | 2/2006 | Kurten et al. | |
| 2006/0066114 | A1 * | 3/2006 | Oberheide | 292/199 |

OTHER PUBLICATIONS

Southco product brochure, "R4 EM Electronic Rotary Latch", [online] [retrieved on Apr. 1, 2009] retrieved from the Internet: <URL http://www.southco.com/resources/documents/R4-EM.en.pdf.

* cited by examiner

*Primary Examiner* — Thomas Beach
*Assistant Examiner* — Nathan Cumar
(74) *Attorney, Agent, or Firm* — Olivia J. Tsai

(57) ABSTRACT

A rotary mechanical latch for positive latching and unlatching of a rotary device with a latchable rotating assembly having a latching gear that can be driven to latched and unlatched states by a drive mechanism such as an electric motor. A cam arm affixed to the latching gear interfaces with leading and trailing latch cams affixed to a flange within the drive mechanism. The interaction of the cam arm with leading and trailing latch cams prevents rotation of the rotating assembly by external forces such as those due to vibration or tampering.

16 Claims, 7 Drawing Sheets

ROTARY MECHANICAL LATCH

RELATED APPLICATIONS

This application claims the benefit of U.S. Provisional Application No. 61/139,044 filed on Dec. 19, 2008, the entirety of which is herein incorporated by reference.

STATEMENT REGARDING FEDERALLY SPONSORED RESEARCH OR DEVELOPMENT

The United States Government has certain rights in this invention pursuant to Department of Energy Contract No. DE-AC04-94AL85000 with Sandia Corporation.

FIELD OF THE INVENTION

The invention generally relates to apparatus and methods for a rotary mechanical latching mechanism to provide positive latching of a rotary device. The invention further relates to rotary latching mechanisms for enclosures that are operable by electrical drive means and are resistant to false unlatchings in a vibrational environment.

BACKGROUND OF THE INVENTION

Rotary latching mechanisms are used to provide controlled access to enclosures with examples ranging from electronics enclosures, vehicle compartments, control rooms etc. Typically a rotary mechanical latch finds application in locking mechanisms for securing the access panels, doors, lids and hatches to an interior volume of a controlled space. In one exemplary non-limiting application, the knob of a door acts as a driving device for applying torque to a rotating shaft that is coupled to a bolt mechanism for withdrawing the bolt from a corresponding strike plate located on the frame of the door. In this and other applications of rotary latching mechanisms, there is a need to prevent rotation of actuating shaft by unauthorized users and a further need to provide the drive input from a remote location (e.g. by electrical drive apparatus). Additionally there is a need for rotary latching mechanisms that provide positive latching of the actuating shaft in an unpowered state (e.g. passive latching) and are resistant to false unlatching of the actuating shaft due to vibrations in the environment of the latch. The present invention meets these needs by providing a positive rotary latching mechanism that is unlatchable by application of a drive torque to lock and unlock a cam arm attached to a rotary actuation shaft, where the cam arm is latched and unlatched by the cooperative positioning of leading and trailing cams incorporated into the drive mechanism.

BRIEF DESCRIPTION OF THE DRAWINGS

The accompanying drawings, which are incorporated in and form part of the specification, illustrate several embodiments of the present invention and, together with the description, serve to explain the principles of the invention. The drawings provided herein are not drawn to scale.

DETAILED DESCRIPTION OF THE INVENTION

Figure 1:
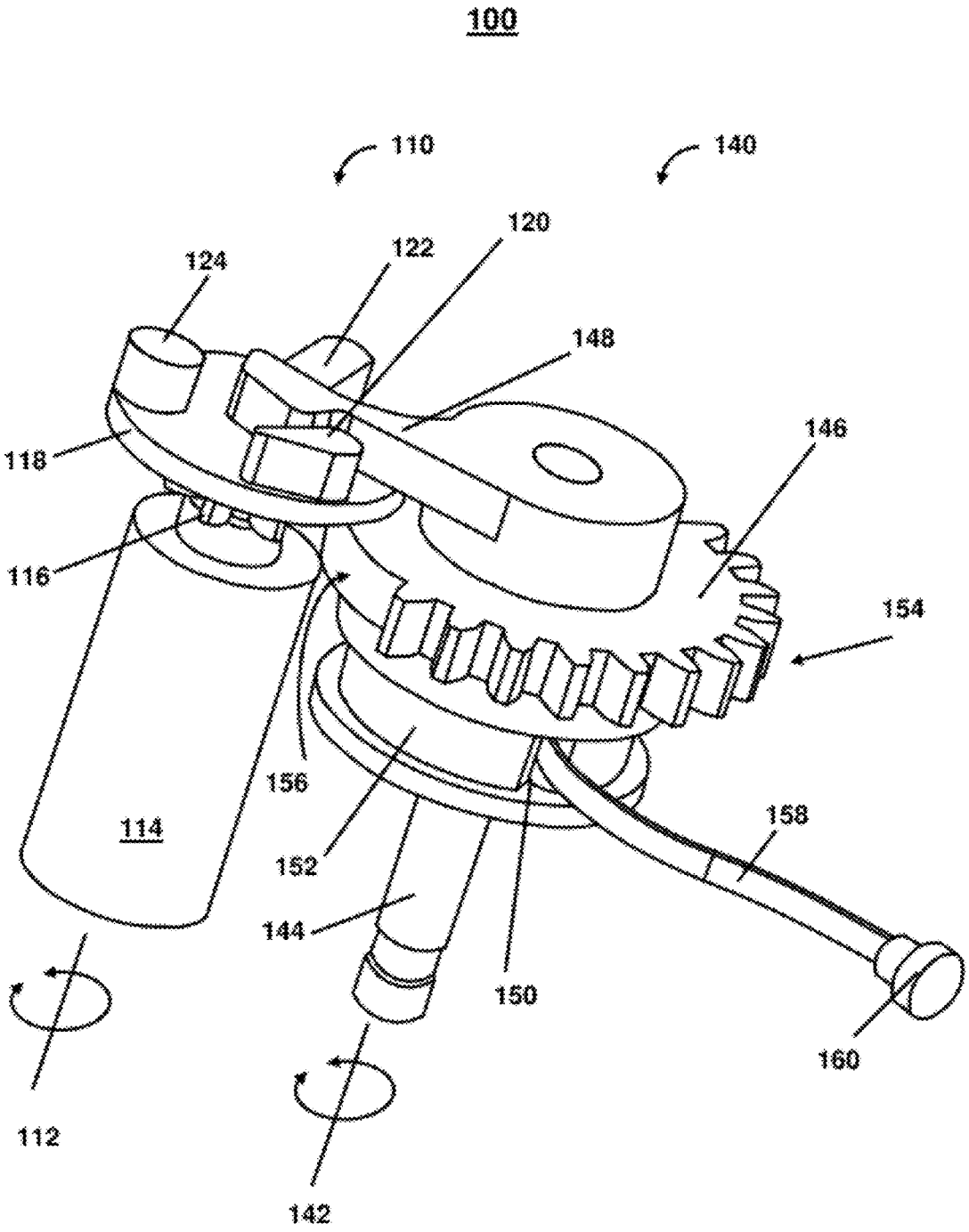
FIG. 1 is a perspective illustration of an embodiment of a rotary mechanical latch according to the present invention.

FIG. 1 is a perspective illustration of an exemplary embodiment of a rotary mechanical latch according to the present invention. Rotary mechanical latch 100 can comprise a drive assembly 110 and a rotating latchable assembly 140. Drive assembly 110 has an axis of rotation 112 that is parallel to and spaced from the rotational axis 142 of the latchable assembly 140. Drive assembly 110 further comprises means for providing a rotational torque such as an electric motor 114 to a pinion gear 116 having a flange 118 supporting leading latch cam 120, trailing latch cam 122 and (optionally) balancing cam 124. In this exemplary embodiment the drive means 114 comprises an electric motor, but could as well comprise a manual drive device such as a knob, wheel or lever, or other motorized drive means such as a solenoid or motor (electrically, pneumatically or hydraulically operated). The latchable assembly 140 comprises an output shaft 144 that can be coupled for example, to insert and withdraw a bolt (not shown) from a strike plate (not shown) in an exemplary non-limiting application such as a door latch. As described below, rotary mechanical latches (e.g. 100) according to the present invention operate to secure the output shaft 144 in a latched (e.g. locked) non-rotatable state and allow shaft 144 to achieve an unlatched (e.g. unlocked) rotatable state only after proper application of a drive torque to the pinion gear 116, by use of drive means 114.

The latchable assembly 140 comprises a latching gear 146, cam arm 148 and a spring catchment 150 that can (as shown in this example) be implemented as a notch on the perimeter of spool 152. The spring catchment 150 can be arranged to capture the free end of a flexural member 158 that as described below, can be configured to apply a latching torque (e.g. via the restoring force of a deformed elastic member) to the latching assembly 140 under certain conditions. The cam arm 148, latching gear 146 and catchment spool 152 fixedly share the axis of rotation 142 and can be assembled onto the output shaft 144 as separate components or can exist as integrally formed or machined components as an application warrants. Latching gear 146 comprises an untoothed portion 156 and a toothed portion 154, the teeth of which are engaged by the teeth of pinion gear 116 during latching and unlatching operations of the rotary latch 100.

In FIG. 1, rotary mechanical latch 100 is illustrated in the latched state, where rotation of output shaft 144 is prevented by the cooperative action of leading cam 120 and trailing cam 122 which "lock" the cam arm 148 in the latched state. In the latched state, the gear teeth of the toothed portion 154 of the latching gear 146 are not engaged with the gear teeth of the pinion gear 116. Latching/locking of the rotary mechanical latch is established by the positional relationship (e.g. interlocking) of the cam arm 148 with the leading 120 and trailing 122 latching cams. As described below, there is no need for power (e.g. manual, electrical etc.) to be applied to the drive means 114 to maintain the output shaft 144 in a latched state and prevent its rotation. Latching of the output shaft 144 is accomplished by rotary mechanical latches 100 of the present invention, by purely passive means.

In an exemplary application, the drive assembly 110 and the latchable assembly 140 can be supported in a common frame or housing, that further can provide an anchor point 160 for the flexible member 158. The free end of the flexible member 158 can slideably engage the recess portion of the spool 152 and can be captured by the spring catchment 150 (e.g. notch or tang) at certain points (described below) during the operation of the rotary mechanical latch 100 to store energy within the flexible member 158 used to produce a latching torque applied to the latching gear 146.

Figure 2:
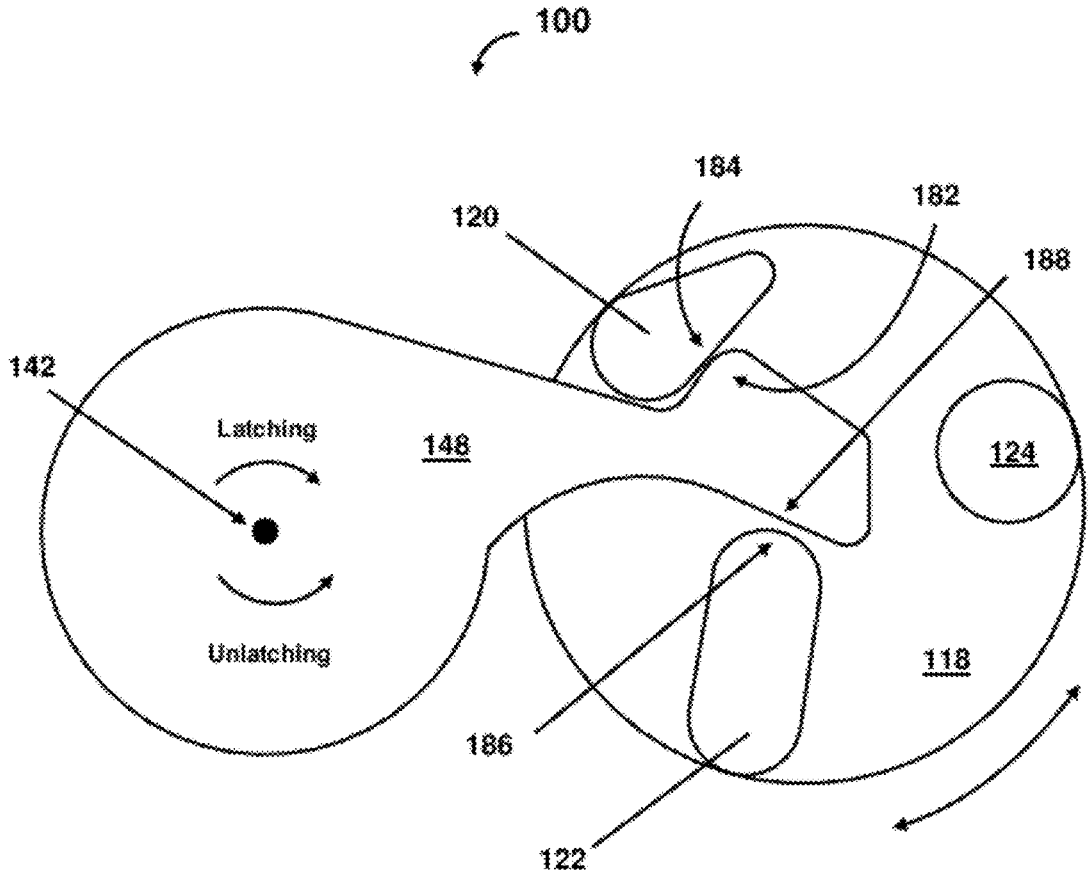
FIG. 2 is a schematic detail view of the embodiment of a rotary mechanical latch of FIG. 1, in a latched state.

FIG. 2 is a schematic detail view of the embodiment of a rotary mechanical latch of FIG. 1, in a latched state. FIG. 2 serves to illustrate the passive nature by which cam arm 148 (and therefore output shaft 144) is secured in a latched state. The terms clockwise and counterclockwise are used herein to illustrate the operation of the invention, and do not serve to limit or restrict the application of the invention to any particular rotational direction or orientation. In the exemplary embodiment illustrated in FIG. 2, the cam arm 148 is prevented from rotating in a counterclockwise manner from the latched state to an unlatched state by the leading latch cam 120. If an attempt is made to rotate the cam arm 148 counterclockwise (e.g. to unlatch) by other than through the use of drive means 114 a curved contacting surface 182 of cam arm 148 is pressed against the corresponding contacting surface 184 of leading latch cam 120, producing by the nature of their curvatures, a counterclockwise "restoring" torque being applied to flange 118, acting to force engagement of the leading cam 120 with the cam arm 148. If an increasing torque is applied to attempt to rotate the cam arm 148 in a counterclockwise direction, a greater contact pressure between surfaces 182 and 184 results, therefore creating an increasing counterclockwise torque applied to the flange 118 and further increasing the engagement of the leading cam 120 with the cam arm 148. An attempt to rotate the cam arm 148 in a clockwise direction by other than through the use of drive means 114 is prevented in a manner similar to above. In a fully latched state, rotation of the cam arm 148 is physically blocked by the presence of trailing latch cam 122. Where the cam arm 148 is slightly unlatched, by the nature of their curvatures, as the contacting surface 188 of the cam arm 148 is pressed against corresponding contacting surface 186 of the trailing latch cam 122, a clockwise torque is applied to flange 118, acting to force engagement of the trailing cam 122 with the cam arm 148.

Therefore power is not required to maintain (e.g. latch, lock) the cam arm 148 in the latched state as the curved nature of contacting surfaces 184, 182, 188 and 186 are such as to generate torques (i.e. "restoring" torques) on the flange 118 acting to force engagement of the cam arm 148 with latch cams 120 and 122 in response to any attempt to rotate the cam arm into an unlatched state. In the present exemplary embodiment, it has been found that a useful geometry can be realized with a teardrop leading cam 120, an oblong trailing cam 122 and a cam arm 148 each having contact surfaces (182, 184, 186 and 188) formed to create the opposing torques acting on the flange 118, by the nature of their curvature. It is to be noted that other geometries could be utilized as well without affecting the practice of the present invention (e.g. an elliptical trailing cam in place of the oblong shaped trailing cam). Optional balancing cam 124 has been found useful in applications where the rotary mechanical latch 100 may be subjected to vibrational environments, either due to normal operational conditions or in attempts to defeat the latching device. By balancing the mass distribution of the latching cams 120 and 122 over the flange 118 with a suitable sized balancing cam 124, motion of a drive assembly 110 in response to those vibrations can be minimized. In this embodiment, balancing cam 124 is illustrated as a cylindrical mass attached to the flange 118, but any shaped mass as convenient to an application could be used as well.

The following series of figures serve to explain the operation of the embodiment of a rotary mechanical latch as presented in FIG. 1. Components below the plane of the illustration, such as spool 152, spring catchment 150 and pinion gear 116 are shown in dashed outline for clarity.

Figure 3:
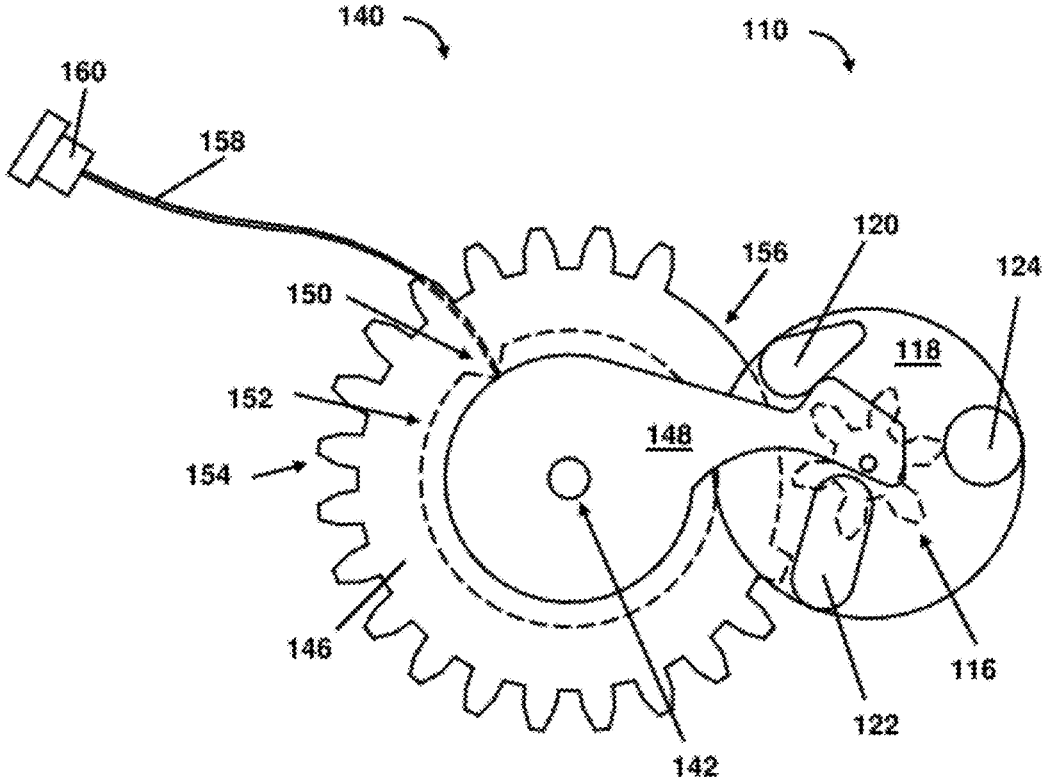
FIG. 3 is a schematic plan view illustration of the embodiment of FIG. 1, in a latched state.

FIG. 3 is a schematic plan view illustration of the embodiment of FIG. 1, in a latched state. Rotation of latching gear 146 and therefore output shaft 144 (not shown) is prevented as cam arm 146 is captured (e.g. locked) between the leading latch cam 120 and trailing latch cam 122. The latch cams 120 and 122 are shaped such that rotation of the latching gear 146 in either direction produces a torque that rotates the flange 118 in a direction to force further engagement of latch cams 120 and 122 with the cam arm 148. Flexible spring element 158 applies clockwise torque to latching gear 148, further resisting counterclockwise rotation of the latching gear. Balancing cam 124 does not engage the cam arm 148 but serves to balance the pinion gear 116, flange 118 and latch cams 120 and 122, so that the drive assembly 110 cannot be easily rotated by mechanical vibrations.

Figure 4:
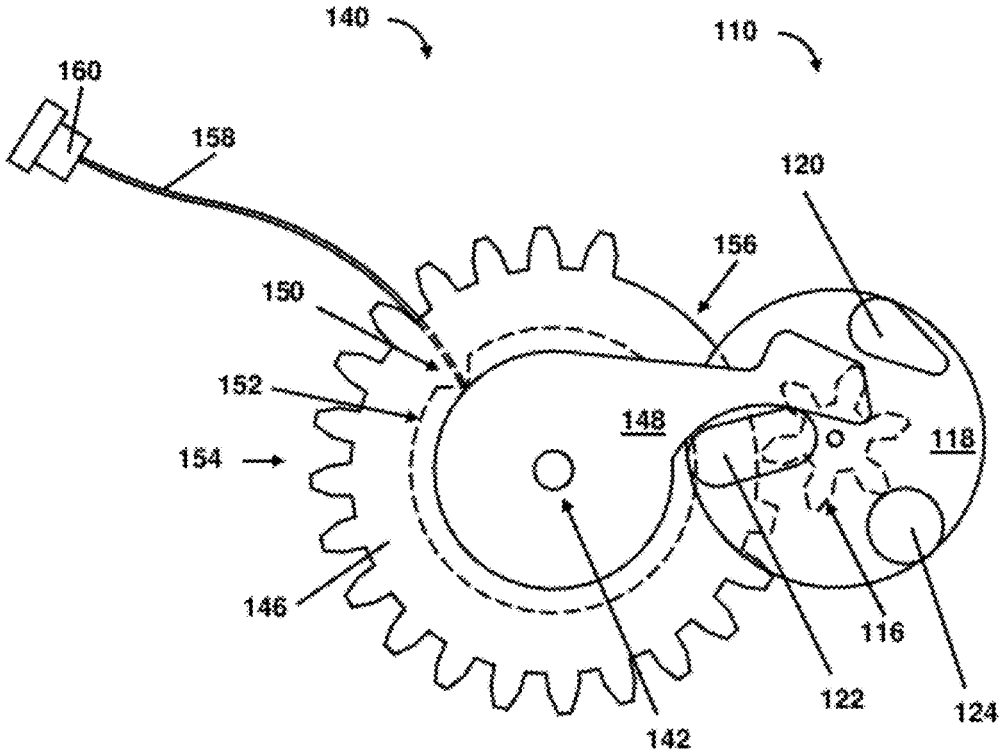
FIG. 4 is a schematic plan view illustration of the embodiment of FIG. 1, in the process of beginning to unlatch.

FIG. 4 is a schematic plan view illustration of the embodiment of FIG. 1, in the process of beginning to unlatch. Drive means 114 (not shown) have been utilized to apply a clockwise torque to pinion gear 116, rotating flange 118 approximately 45 degrees to a point where the leading latch cam 120 no longer interferes with the cam arm 148. The interior edge of the trailing latch cam 122 is driving the latching gear 146 via contact with the cam arm 148, and latching gear 146 is now free to continue rotation in a counter clockwise direction. The spring element 158 continues to provide a clockwise torque to the latchable assembly 140 at this point, which the drive means must overcome. In the exemplary embodiment, the drive means 114 (an electric motor) continues to drive (e.g. rotate clockwise) the pinion 116 somewhat beyond this point.

Figure 5:
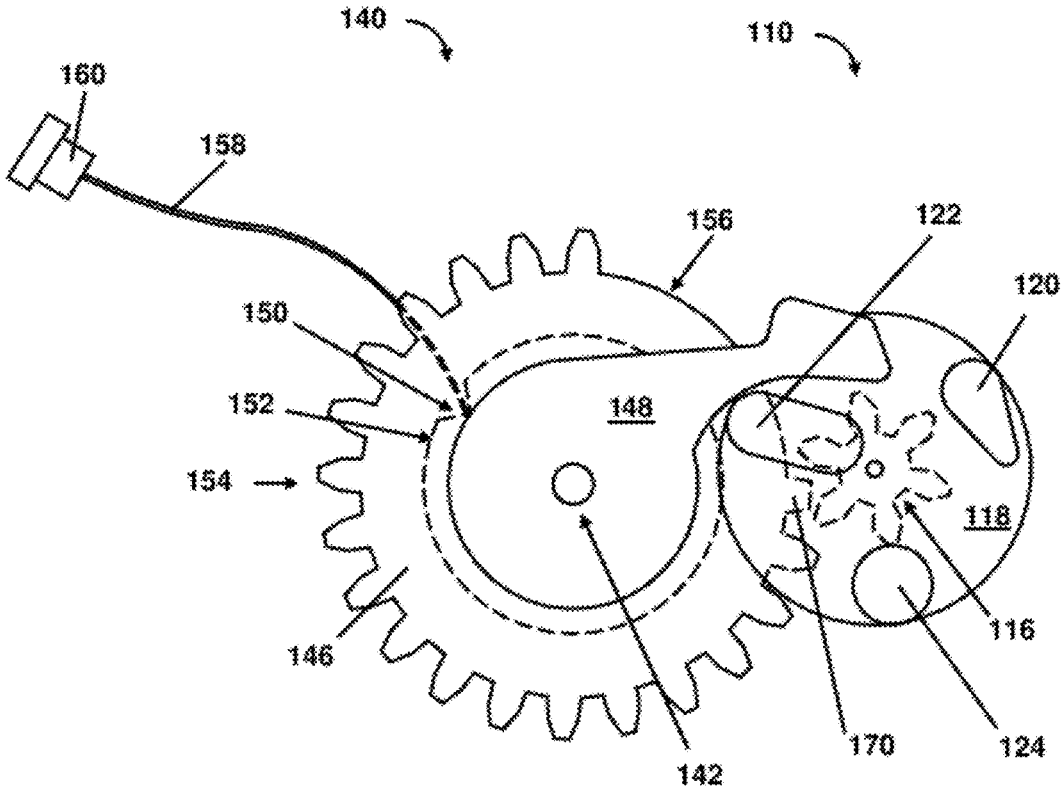
FIG. 5 is a schematic plan view illustration of the embodiment of FIG. 1, in the process of unlatching where the teeth of the pinion gear are beginning to engage the toothed portion of the latching gear.

FIG. 5 is a schematic plan view illustration of the embodiment of FIG. 1, in the process of unlatching where the teeth of the pinion gear are beginning to engage the toothed portion of the latching gear. In FIG. 5 the drive means 114 has rotated the pinion gear 116 and flange 118 to a point where the outer extent of the trailing cam 122 is pushing the cam arm 148, causing continued counterclockwise rotation of latching gear 146. The teeth of pinion gear 116 are about to engage the first tooth 170 on the toothed portion 154 of the latching gear 146. Gear tooth 170 is illustrated as being shortened which has been found to facilitate engagement with the pinion gear 116. In this embodiment, the outline of the contacting surfaces of the cam arm 148 and trailing latch cam 122 are such that the rotation ratio (e.g. here 4:1) of the pinion gear 116 and the latching gear 146 is the same as if their gear teeth were engaged. Further counterclockwise rotation of the latching gear 146 is now driven by engagement of the pinion gear 116 with the toothed portion 154 of the latching gear. Engagement of the gear teeth maintain the proper phase relationship between the latching gear 146 and the pinion gear 116 to insure the latching cams 120 and 122 will properly engage with the cam arm 148 upon latching. The spring flexural member 158 is near its overthrown position, i.e. where it will escape the spring catchment 150.

Figure 6:
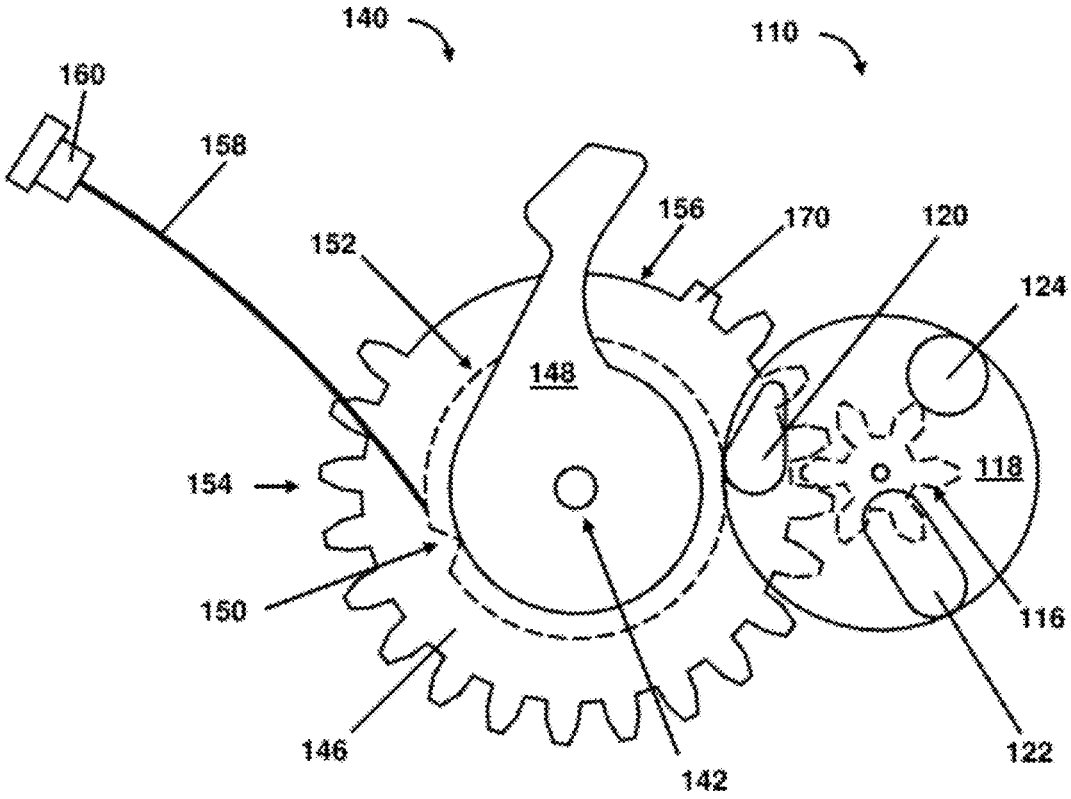
FIG. 6 is a schematic plan view illustration of the embodiment of FIG. 1, in an unlatched state.

FIG. 6 is a schematic plan view illustration of the embodiment of FIG. 1, in an unlatched state. FIG. 6 shows the cam arm 148 completely disengaged from the latching cams 120 and 122. The latching gear 146 is free to rotate (i.e. through less than 360 degrees) within the limits defined at either end where the cam arm 146 would encounter a latching cam (120, 122). At this point, the end of flexural member 158 has escaped the spring catchment 150 and is no longer applying a torque to the latching gear 146. Drive means 114 no longer needs to be powered and can be allowed to freely rotate, allowing latching gear 146 to rotate freely as well (i.e. latching gear is "unlocked"). The unlatched state therefore does not consist of a singular position of the latching gear 146, but rather comprises all rotational orientations of the latching gear 146 from the point at which the teeth of the pinion gear 116 begin to engage the first tooth 170 of the latching gear 146 continuing around to the orientation where further rotation would cause the cam arm 148 to collide with a cam.

Figure 7:
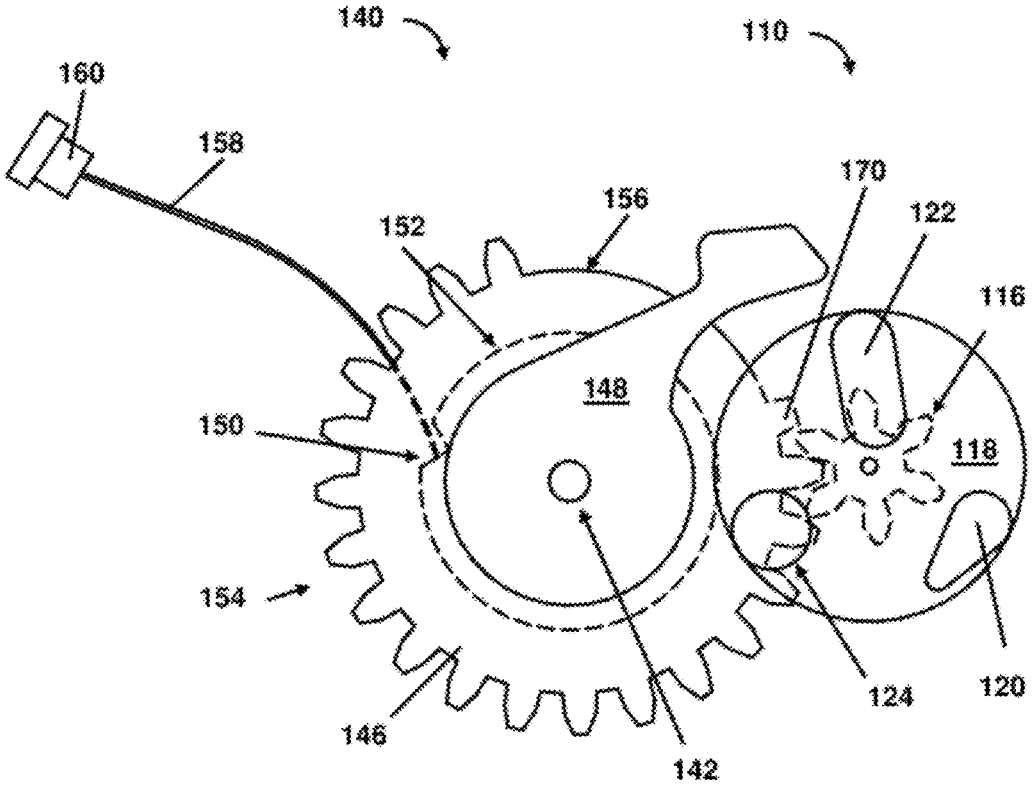
FIG. 7 is a schematic plan view illustration of the embodiment of FIG. 1, in the process of beginning to relatch.

FIG. 7 is a schematic plan view illustration of the embodiment of FIG. 1, in the process of beginning to relatch. FIG. 7 illustrates the beginning of a latching sequence. The latching gear 146 has been rotated clockwise by the drive means 114 to the point where the end of flexural member 158 is captured by spring catchment 150, and the force of continued rotation of latching gear 146 causes the flexural member 158 to begin to buckle. The drive means 114 applies a torque to the latching gear 146 to rotate the latching gear up to the overthrow point of the flexural element 158. After the overthrow, the flexural element 158 provides the torque needed to latch the rotary latch 100, as shown in FIG. 5. The flexural element 158 is providing torque to the latching gear 146 driving the pinion gear 116 counterclockwise. At this point, the latching gear 146 and pinion gear 116 teeth are just beginning to disengage and continued rotation of the pinion gear 116 is driven by the contact between the cam arm 148 and the trailing latch cam 122. The torque provided by the flexural member 158 continues to drive the latching gear 146 and pinion gear 116 through the position shown in FIG. 4 and into the fully latched position as shown in FIG. 3.

The exemplary embodiment of a rotary latch is described in the preceding text as allowing a rotation of the cam arm 148 in an unlatched state through less than 360 degrees. The invention could as well be applied to rotary latches wherein the cam arm 148 was allowed to rotate through a greater rotational angle (i.e. greater than 360 degrees) for example, by providing a rotary ramp element that would move the pinion gear 118 (e.g. or the cam arm itself) out of engagement with the cam arm 148 thereby allowing a greater degree of rotation.

In one exemplary application of the embodiment described above, a rotary mechanical latch has been built and operated with a DC motor drive means (114), and found to cosume 40 millijoules to unlatch. This example serves to illustrate suitability of rotary mechanical latches according to the present invention, to low power applications.

The above described exemplary embodiments present several variants of the invention but do not limit the scope of the invention. Those skilled in the art will appreciate that the present invention can be implemented in other equivalent ways. The actual scope of the invention is intended to be defined in the following claims.

What is claimed is:

1. A rotary mechanical latch for positive latching and unlatching of a rotary device, the latch comprising:

a latchable rotatable assembly having a first axis of rotation including, a latching gear rotatable about the first axis and having a perimeter including a toothed portion and an untoothed portion, a cam arm affixed to the latching gear and rotatable about the first axis, the cam arm having an extension aligned with the untoothed portion of the latching gear, a spring catchment spool affixed to the latching gear and having a perimeter and a spring catchment disposed on the perimeter of the spool, a shaft rotatable about the first axis, the latching gear, the cam arm and the catchment spool fixedly mounted on the shaft;

a drive assembly having a second axis of rotation parallel to and spaced from the first axis, the drive assembly comprising, a pinion gear rotatable about the second axis and having a flange, the pinion gear engageable with the toothed portion of the latching gear, a drive means for providing a drive torque to the pinion gear, and, a leading latch cam and a trailing latch cam affixed to a face of the flange, the leading latch cam and the trailing latch cam operatively arranged to cooperatively engage the cam arm in a latched state such that counter-clockwise rotation of the cam arm and subsequent contact by the cam arm to the leading latch cam generates a counter-clockwise torque applied to the flange which increases engagement of the leading latch cam with the cam arm to further enforce the cam arm being in the latched state and such that clockwise rotation of the cam arm and subsequent contact by the cam arm to the trailing latch cam generates a clockwise torque applied to the flange which increases engagement of the trailing latch cam with the cam arm to further enforce the cam arm being in the latched state and, disengage the cam arm in an unlatched state, the latched and unlatched states selectable by operation of said drive means, the latched state preventing rotation of the shaft and the unlatched state allowing a rotation of the shaft, the pinion gear not engaging the toothed portion of the latching gear in the latched state.

2. The apparatus of claim 1 wherein the unlatched state allows a rotation of the shaft through less than 360 degrees.

3. The apparatus of claim 1 further comprising a flexible spring element, the flexible spring element engageable with the spring catchment on the catchment spool and operatively arranged to provide a latching drive torque to the rotatable assembly in the latched state.

4. The apparatus of claim 3 wherein the flexible spring element is further operatively arranged to provide a latching drive torque to the rotatable assembly in the unlatched state.

5. The apparatus of claim 1 wherein said drive means comprises one or more of an electrical motor drive, an electrical solenoid drive and a manual drive.

6. The apparatus of claim 1 further comprising a balancing weight affixed to the face of the flange, the balancing weight operatively arranged to rotationally balance the actuation assembly during operations of the drive means, thereby reducing vibrations during operation.

7. The apparatus of claim 1 wherein the leading latch cam comprises a teardrop cam and the trailing latch cam comprises an oblong cam.

8. A rotary mechanical latch for positive latching and unlatching of a rotary device, the latch comprising:

a latchable rotatable assembly having a first axis of rotation including, a latching gear rotatable about the first axis and having a perimeter including a toothed portion and an untoothed portion, a cam arm affixed to the latching gear and rotatable about the first axis, the cam arm having an extension aligned with the untoothed portion of the latching gear, the extension having a first contacting surface and a second contacting surface, a spring catchment spool affixed to the latching gear and having a perimeter and a spring catchment disposed on the perimeter of the spool, a shaft rotatable about the first axis, the latching gear, the cam arm and the catchment spool fixedly mounted on the shaft;

a drive assembly having a second axis of rotation parallel to and spaced from the first axis, the drive assembly comprising, a pinion gear rotatable about the second axis and having a flange, the pinion gear engageable with the toothed portion of the latching gear, a drive means for providing a drive torque to the pinion gear, and, a leading latch cam having a third contacting surface and a trailing latch cam having a fourth contacting surface, the leading latch cam and the trailing latch cam affixed to a face of the flange, the leading latch cam and the trailing latch cam operatively arranged to cooperatively engage the extension in a latched state and, disengage the extension in an unlatched state, the latched and unlatched states selectable by operation of said drive means, the latched state preventing rotation of the shaft and the unlatched state allowing a rotation of the shaft, the pinion gear not engaging the toothed portion of the latching gear in the latched state, the first contacting surface on the extension operatively arranged to produce a counter-clockwise latching torque on the flange when the extension is rotated counter-clockwise to contact the third contacting surface on the leading latch cam which increases engagement of the leading latch cam with the extension to enforce the latched state and the second contacting surface on the extension operatively arranged to produce a clockwise latching torque on the flange when the extension is rotated clockwise to contact the fourth contacting surface on the trailing latch cam which increases engagement of the trailing latch cam with the extension to enforce the latched state.

9. The apparatus of claim 8 wherein the unlatched state allows a rotation of the shaft through less than 360 degrees.

10. The apparatus of claim 8 further comprising a flexible spring element, the flexible spring element engageable with the spring catchment on the catchment spool and operatively arranged to provide a latching drive torque to the rotatable assembly in the latched state.

11. The apparatus of claim 10 wherein the flexible spring element is further operatively arranged to provide a latching drive torque to the rotatable assembly in the unlatched state.

12. The apparatus of claim 8 wherein said drive means comprises one or more of an electrical motor drive, an electrical solenoid drive and a manual drive.

13. The apparatus of claim 8 further comprising a balancing weight affixed to the face of the flange, the balancing weight operatively arranged to rotationally balance the drive assembly.

14. The apparatus of claim 8 wherein the leading latch cam comprises a teardrop cam and the trailing latch cam comprises an oblong cam.

15. The apparatus of claim 8 wherein the latched state and the unlatched state correspond to a rotation of the latching gear through a rotation angle of less than forty five degrees.

16. The apparatus of claim 15 wherein the rotation angle is approximately thirty six degrees.

* * * * *